US010914495B2

(12) United States Patent
Bunch et al.

(10) Patent No.: US 10,914,495 B2
(45) Date of Patent: Feb. 9, 2021

(54) APPARATUS FOR HEAT TRANSFER, UTILIZING THE JOULE THOMSON (JT) EFFECT, FOR CROWNING UPON HEAT-EMITTING DEVICES

(71) Applicant: THE BOEING COMPANY, Chicago, IL (US)

(72) Inventors: Ernest E. Bunch, Huntington Beach, CA (US); Christopher C. Veto, Hawthorne, CA (US)

(73) Assignee: THE BOEING COMPANY, Chicago, IL (US)

( * ) Notice: Subject to any disclaimer, the term of this patent is extended or adjusted under 35 U.S.C. 154(b) by 433 days.

(21) Appl. No.: 15/707,898

(22) Filed: Sep. 18, 2017

(65) Prior Publication Data

US 2019/0086126 A1 Mar. 21, 2019

(51) Int. Cl.

| | |
|---|---|
| ***F25B 9/02*** | (2006.01) |
| ***F25D 19/00*** | (2006.01) |
| *F25D 3/12* | (2006.01) |
| *F25D 3/10* | (2006.01) |

(52) U.S. Cl.

CPC ..... *F25B 9/02* (2013.01); *F25D 19/00* (2013.01); *F25B 2309/022* (2013.01); *F25B 2500/01* (2013.01); *F25B 2500/05* (2013.01); *F25D 3/10* (2013.01); *F25D 3/12* (2013.01); *F25D 2400/28* (2013.01)

(58) Field of Classification Search

CPC .... F25B 9/02; F25B 2309/022; F25B 250/01; F25B 2500/05; F25D 18/00; F25D 3/10; F25D 3/12; F25D 2400/28

See application file for complete search history.

(56) References Cited

U.S. PATENT DOCUMENTS

| | | | | |
|---|---|---|---|---|
| 2,410,310 | A * | 10/1946 | Smith | F25D 29/008 116/103 |
| 2,746,264 | A | 5/1956 | Keyes | |
| 5,745,834 | A | 4/1998 | Bampton et al. | |
| 5,805,971 | A | 9/1998 | Akedo | |
| 2015/0119962 | A1* | 4/2015 | Kulstad | A61F 7/10 607/105 |
| 2016/0338527 | A1* | 11/2016 | Burrows | A47J 31/465 |

FOREIGN PATENT DOCUMENTS

| | | | |
|---|---|---|---|
| FR | 2223986 | A6 | 10/1974 |
| WO | 9745684 | A1 | 12/1997 |

OTHER PUBLICATIONS

Extended European Search Report for Application No. 18193375.5-1009 dated Feb. 14, 2019.

* cited by examiner

*Primary Examiner* — Brian M King

(74) *Attorney, Agent, or Firm* — Patterson + Sheridan, LLP

(57) ABSTRACT

Embodiments of the present disclosure generally relate to heat transferring apparatuses and methods. The apparatus and methods utilize the Joule-Thomson effect to remove heat from a heat source to facilitate cooling of the heat source. In one example, an apparatus receives heat from an object to be cooled. The received heat is used to pressurize a fluid. The pressurized fluid is depressurized through a venturi using vapor pressure as a driving force, thus cooling the fluid.

19 Claims, 14 Drawing Sheets

APPARATUS FOR HEAT TRANSFER, UTILIZING THE JOULE THOMSON (JT) EFFECT, FOR CROWNING UPON HEAT-EMITTING DEVICES

BACKGROUND

Field

Embodiments of the present disclosure generally relate to heat transfer apparatuses and methods.

Description of the Related Art

In thermodynamics, the Joule-Thomson effect describes the temperature change of a fluid, such as a gas or liquid, when the fluid is forced through a valve or porous plug while kept insulated so that no heat is exchanged with the environment. This procedure is often referred to as a throttling process or Joule-Thomson process. Conventional throttling processes utilize large and expensive equipment, and therefore are impractical or unusable for many applications.

Therefore, what is needed is an improved heat transfer device.

SUMMARY

Embodiments of the present disclosure generally relate to heat transferring apparatuses and methods. The apparatus and methods utilize the Joule-Thomson effect to remove heat from a heat source to facilitate cooling of the heat source.

In one aspect, a heat transfer device comprises a body and a lid assembly positioned on the body and defining an internal volume of the body. An internal container is located within the body and includes a bowl having an internal volume therein. The internal volume of the bowl is separated from the internal volume of the body by a sealing member positioned over an opening formed through a sidewall of the bowl. The opening includes a venturi. The heat transfer device also includes a puncturing device positioned to rupture the sealing member In another aspect, a heat transfer device comprises a body and a lid assembly positioned on the body and defining an internal volume of the body. An internal container is located within the body. The internal container includes a bowl having an internal volume therein. The internal volume of the bowl is separated from the internal volume of the body by a plurality of sealing members positioned over openings formed through a sidewall of the bowl. The openings each include a venturi. The heat transfer device also includes a plurality of puncturing devices radially disposed around the body and aligned with each opening to rupture respective sealing members.

In another aspect, a method of cooling an object comprises positioning a heat transfer device adjacent to the object, and transferring heat from the object to fluid housed within the heat transfer device, thereby increasing the temperature and the pressure of the fluid. A sealing member is ruptured to release the heated fluid and allow the fluid to expand and cool.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure generally relate to heat transferring apparatuses and methods. The apparatus and methods utilize the Joule-Thomson effect to remove heat from a heat source to facilitate cooling of the heat source.

Figure 1A:
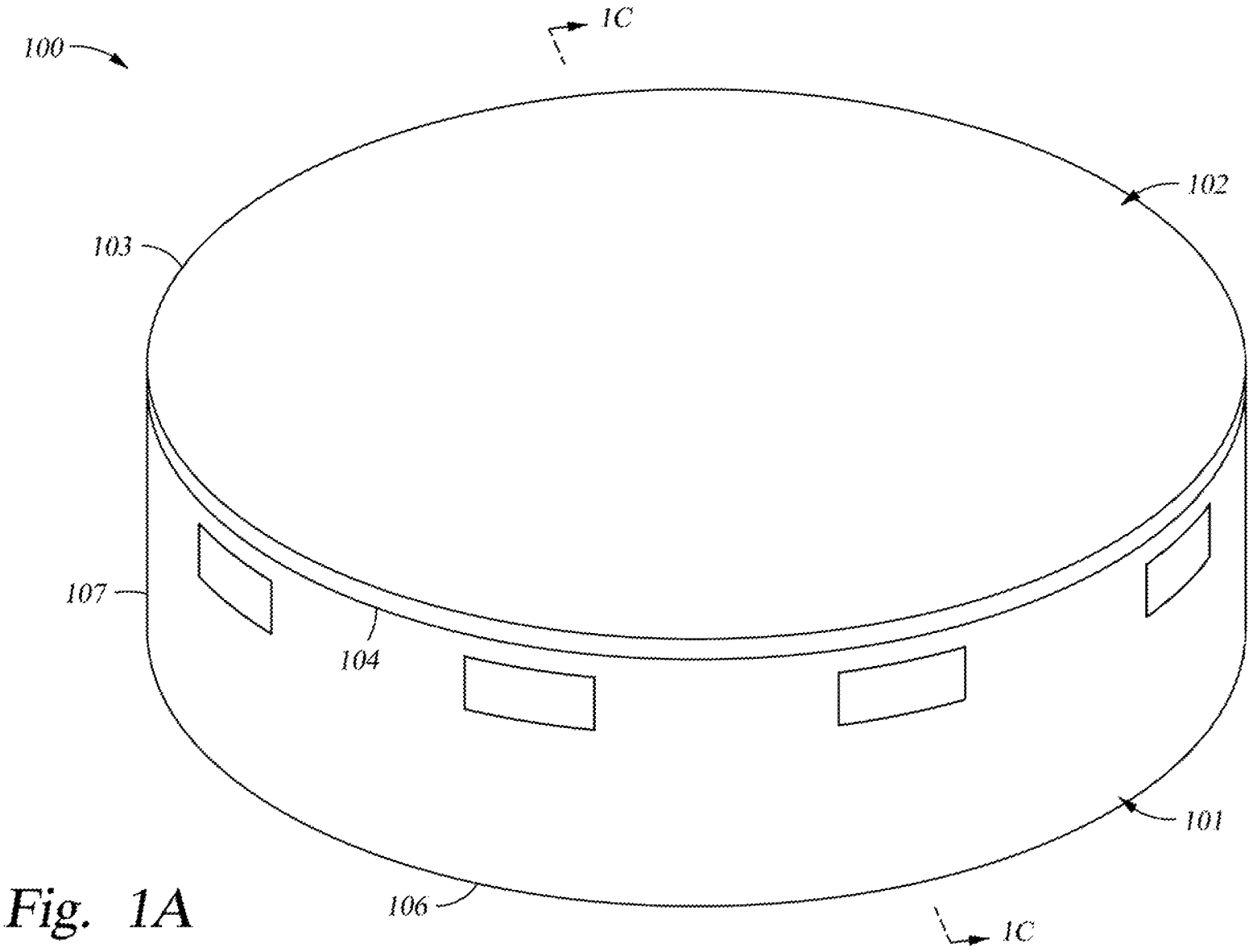
FIGS. 1A and 1B are schematic perspective views of a heat transfer device, according to one aspect of the disclosure.
Figure 1B:
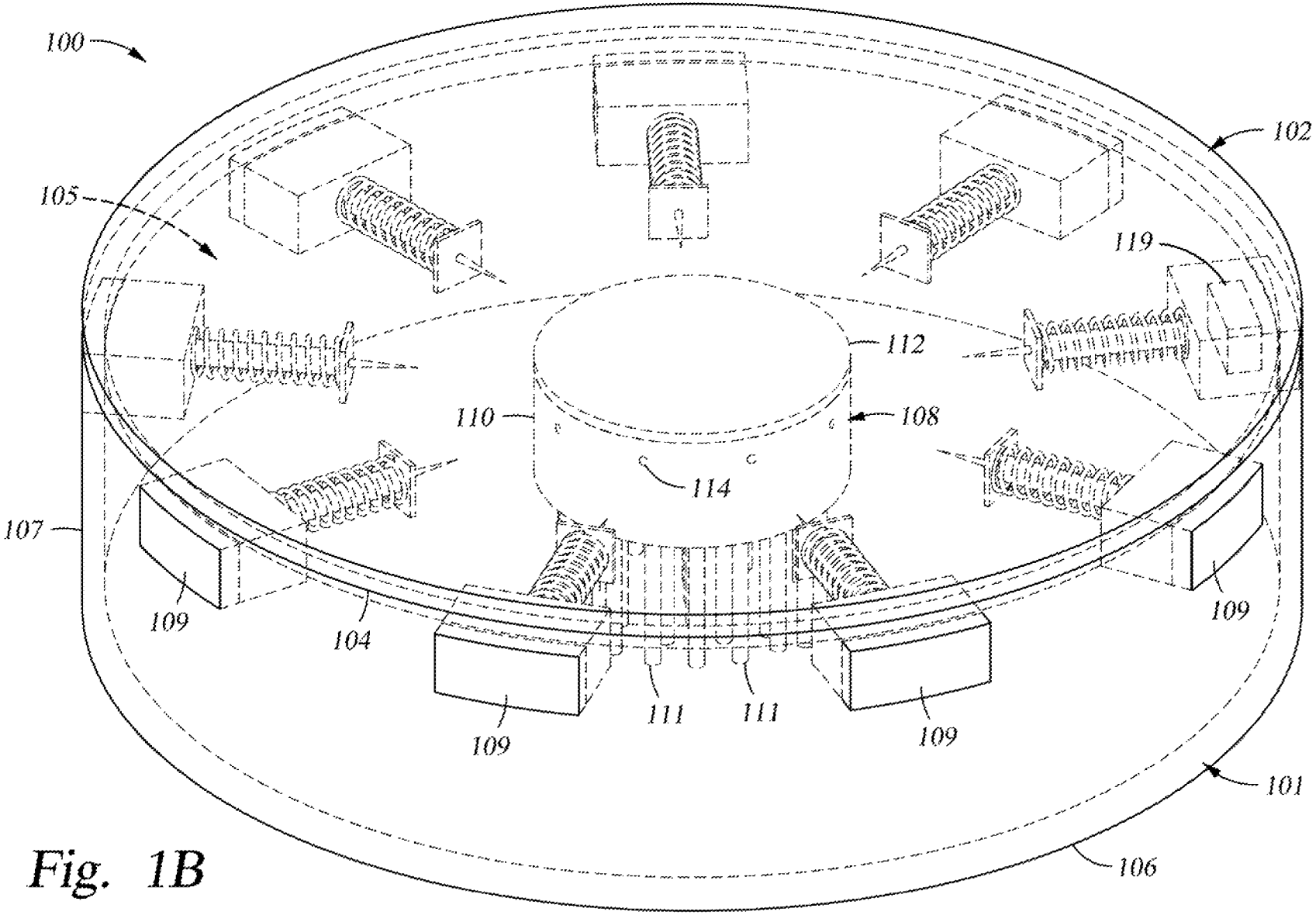
Figure 1C:
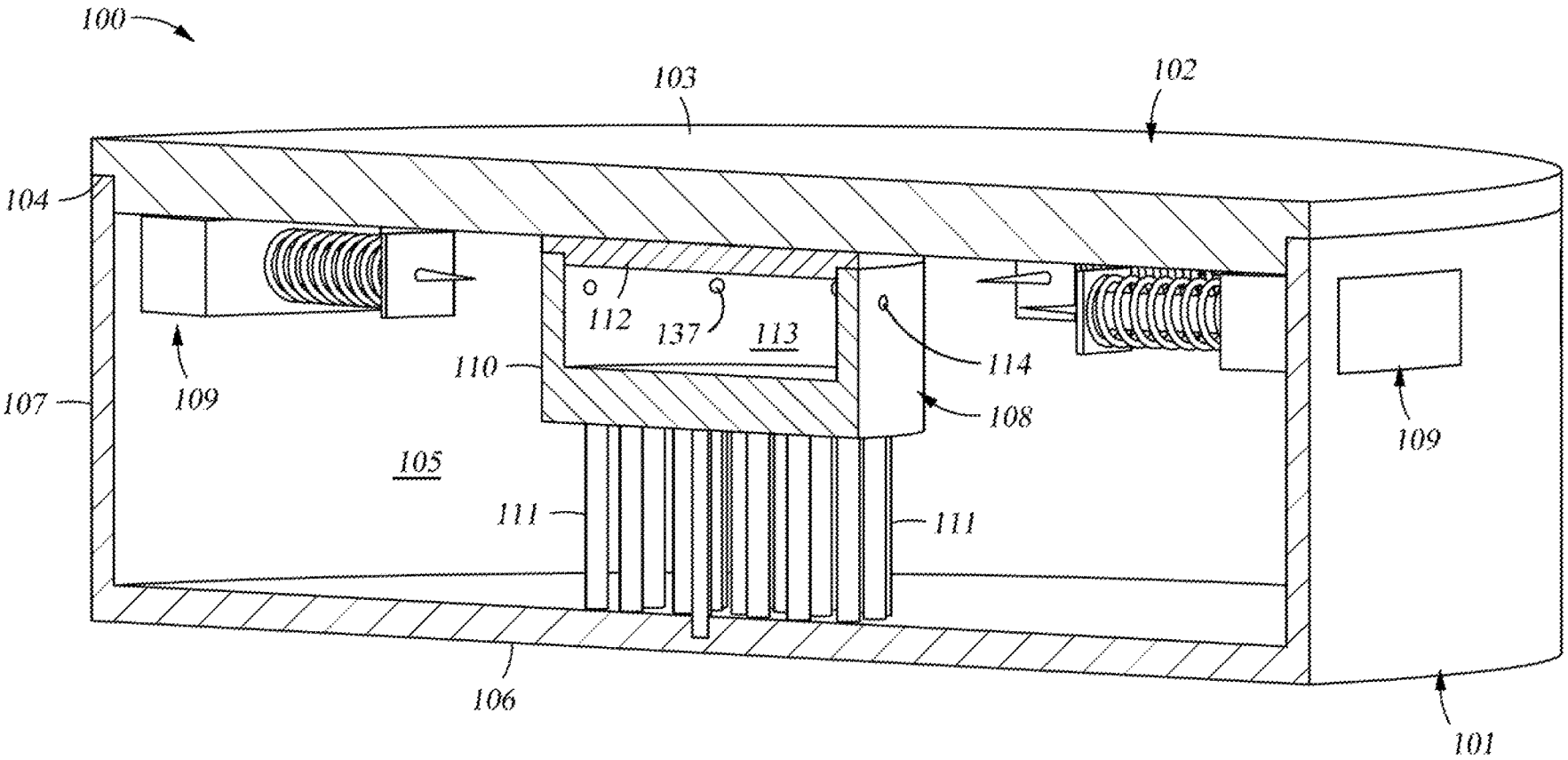
FIG. 1C is a schematic sectional view of the heat transfer device of FIG. 1A.
Figure 1D:
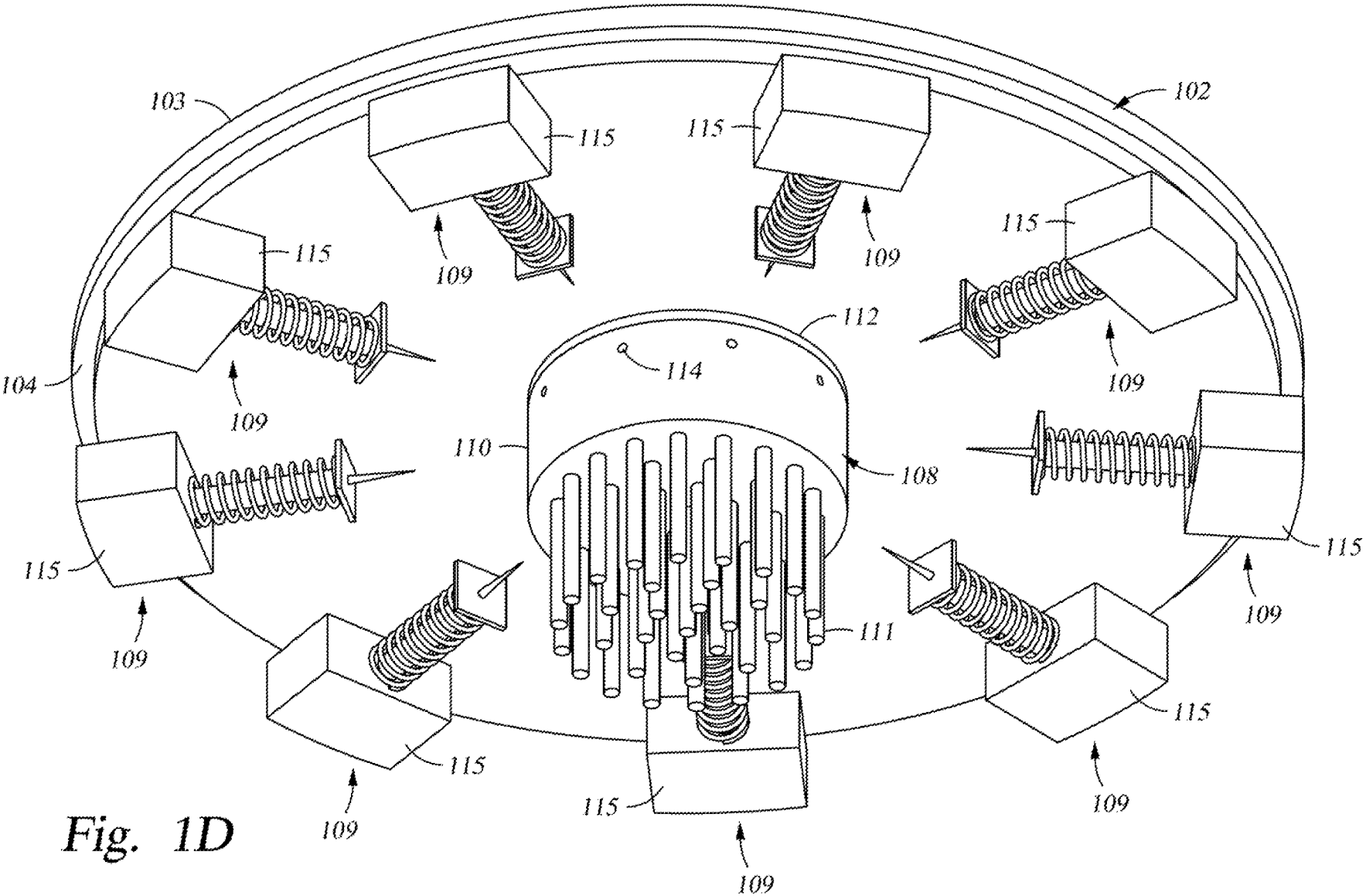
FIG. 1D is a schematic partial view of the heat transfer device of FIG. 1A.
Figure 1E:
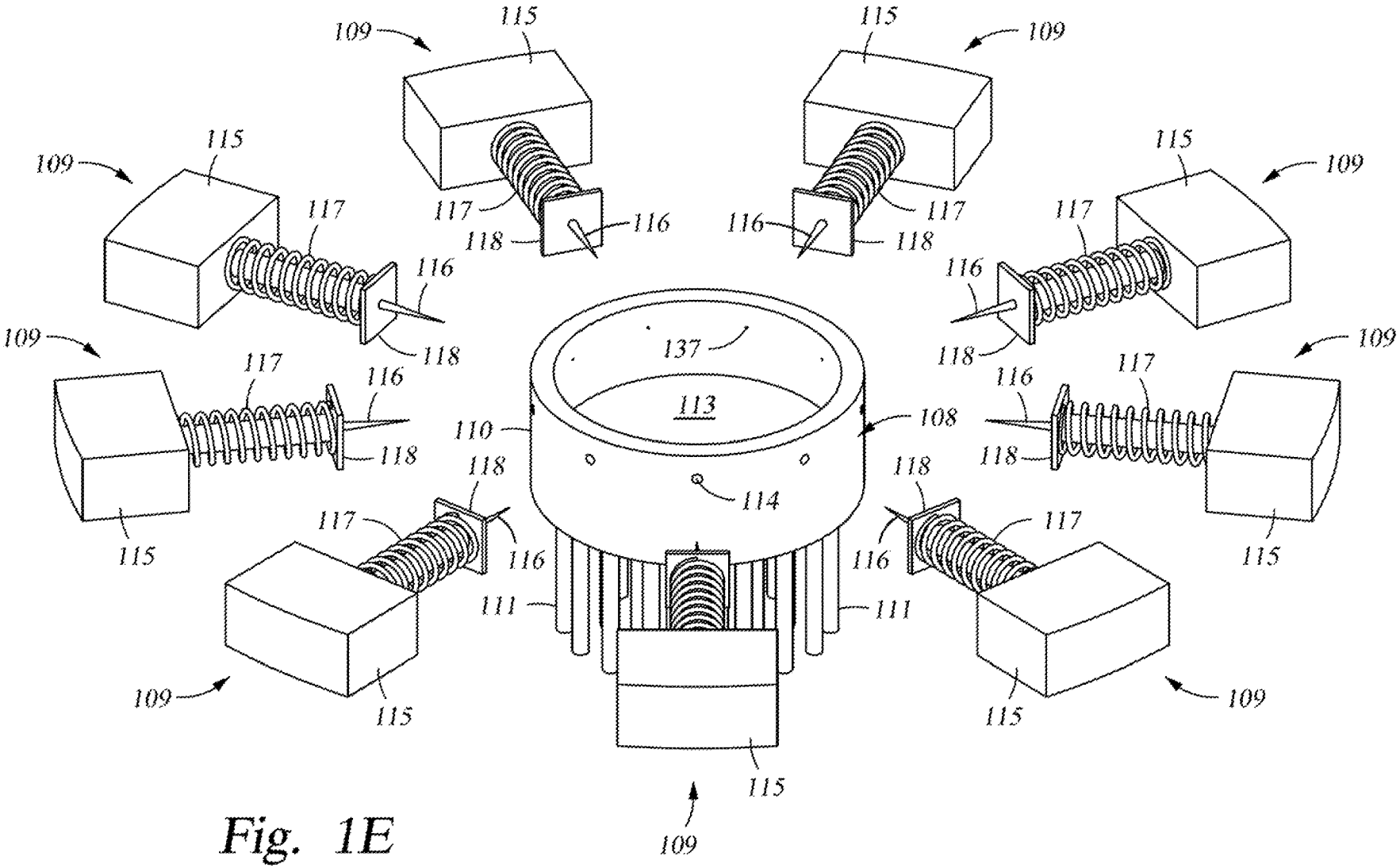
FIG. 1E is a schematic partial exploded view of the heat transfer device of FIG. 1A.

FIGS. 1A and 1B are schematic perspective views of a heat transfer device 100, according to one aspect of the disclosure. FIG. 1C is a schematic sectional view of the heat transfer device of FIG. 1A. FIG. 1D is a schematic partial view of the heat transfer device of FIG. 1A. FIG. 1E is a schematic partial exploded view of the heat transfer device of FIG. 1D. To facilitate explanation, FIGS. 1A-1E are explained in conjunction.

The heat transfer device 100 includes a body 101 and a lid assembly 102 disposed thereon. The body 101 includes a base 106 and a side wall 107 extending from the base 106. The lid assembly 102 includes a cylindrical plate 103 having a stepped surface 104 formed in a radially outward edge thereof. The stepped surface 104 engages the upper end of the sidewall 107 forming a seal therebetween. In one example the stepped surface 104 engages the upper end of the sidewall 107 in an interference fit. Additionally or alternatively, an adhesive may be applied between the stepped surface 104 and the sidewall 107 to couple the lid assembly 102 to the body 101.

The body 101 and the lid assembly 102 define an interior volume 105 therein. The interior volume 105 includes therein an internal container 108 and one or more puncturing devices 109 (nine are shown in FIG. 1B). The internal container 108 is centrally located with respect to the base 106 of the body 101, as well as centrally located with respect to the lid assembly 102. Thus, in one example, the internal container 108 is concentric with respect to the body 101 and the lid assembly 102. The internal container 108 includes a bowl 110 positioned adjacent the lid assembly 102, and one or more heat sinks 111 coupled to a lower surface of the bowl 110. The one or more heat sinks 111 are in physical contact with an internal surface of the base 106 of the body 101, and also in physical contact with a lower external surface of the bowl 110. The one or more heat sinks 111 are illustrated as having a cylindrical shape and being in spaced apart relationships, but it is contemplated that other shapes and configurations may be selected depending on heat transfer-, weight-, space-, or cost-parameters.

A cap 112 is positioned over the bowl 110. The cap 112 seals against the bowl 110 to define an internal volume 113. The cap 112 may be integrally formed with and extending from a lower surface of the cylindrical plate 103, or may be a separate component therefrom. Alternatively, it is contemplated that the lower surface of the cylindrical plate 103 may seal against the bowl 110, and thus, a cap 112 would be unnecessary. To facilitate sealing with the bowl 110, the cap 112 may include a stepped surface around a perimeter thereof. In such an example, a portion of the stepped surface may be disposed within the inner diameter of the bowl 110, for example by an interference fit, while a second portion of the stepped surface mates against an upper end of a sidewall of the bowl 110. The internal volume 113 is a fluid-tight compartment configured to contain a fluid therein, such as a liquid or a gas (for example, ammonium ($NH_4$)). While the internal volume is illustrated as having a cylindrical shape, other shapes or configurations are contemplated.

The bowl 110 includes one or more openings 114 formed through a sidewall thereof. The one or more openings 114 correspond to (in a one-to-one relationship) and are radially aligned with a respective puncturing device 109. Each of the openings 114 are initially sealed with a sealing member 137, such as a membrane or diaphragm, capable of being punctured by the puncturing device 109. The sealing members 137 are capable of withstanding a predetermined level of pressure without unintentional rupturing. The sealing members 137 isolate the internal volume 113 of the bowl 110 from the internal volume 105 of the body 101 until ruptured. In one example, the sealing members 137 are formed from one or more of an elastomeric, polymeric, and metallic material. In another example, the sealing members are formed from one or more of carbon steel, stainless steel, nickel-molybdenum alloys such as Hastelloy®, graphite, aluminum, silicone, and a high temperature rubber compound.

Each of the one or more openings 114 is shaped as a venturi, e.g., having a narrow section located between two wider sections. Alternatively, each of the one or more openings 114 is conically-shaped with a base of the cone positioned radially outward. In such a case, the internal volume 113 functions as a wider section of a venturi on one end thereof, while the apex of the cone corresponds to a narrow section and the base corresponds to the second wider section. In yet another embodiment, each of the one or more openings 114 is a cylindrical orifice formed through the sidewall of the bowl 110. In such an example, the cylindrical orifice functions as the narrow portion of the venturi, while the internal volume 113 and the internal volume 105 function as the wider sections of the venturi. In yet another example, a venturi-shaped section of material may be coupled to an internal or external surface of the bowl 110, over a respective opening 114. In the above configurations, it is contemplated that the venturi is sized and positioned to allow the puncturing devices 109 to puncture a respective sealing member 137 within the one or more openings 114.

Each puncturing device 109 includes a housing 115, a needle 116, a spring 117, and a stop plate 118. The puncturing devices 109 are radially spaced around the internal container 108 and located radially outward relative thereto. The puncturing devices 109 are coupled to the body 101 and extend radially inward from the body 101. The housing 115 engages an opening having a corresponding shape formed in the sidewall of the body 101. Such engagement facilitates coupling of respective puncturing devices 109 to the body 101, and additionally, facilitates ease of installation, maintenance, and replacement of the puncturing devices 109 without requiring removal of the lid assembly 102. However, it is contemplated that instead of engaging a corresponding opening formed in the body 101, the puncturing devices 109 may be secured to an internal surface of the body 101, or an internal surface of the lid assembly 102.

Each housing 115 includes a release mechanism 119 (one shown schematically in FIG. 1B) therein to facilitate release of the needle 116. Upon release, the needle 116 is biased by the spring 117. The spring 117 is disposed around a base portion of the needle 116 and is positioned to bias against the housing 115 and the stop plate 118. Thus, in some examples, the needle 116 is spring-loaded. A tip of the needle 116 extends radially inward from the stop plate 118 to engage a respective opening 114, thereby puncturing a sealing member 137 of the respective opening 114. The stop plate 118 is configured to contact an outer surface of the bowl 110 to prevent over-penetration of the needle 116, which may result in the needle 116 becoming stuck in the opening 114 and thus complicating removal or retraction therefrom. Retraction of the needle 116 from the opening 114 may be effected by the release mechanism 119, by a separate actuator located within the housing 115, or by pressure of fluid traveling from the internal volume 113 of the bowl to the internal volume 105.

During operation of the heat transfer device 100, the heat transfer device 100 is thermally coupled to an object to be cooled. For example, the base 106 of the body 101 is positioned in physical contact with the object to be cooled. As the temperature of the object increases, thermal energy is transferred from the object to a fluid stored in bowl 110 of the internal container 108. The heat sinks 111 facilitate transfer of heat from the object, through the base 106, to the bowl 110 and the fluid therein. To facilitate heat transfer, the base 106, the heat sinks 111, and the bowl 110 may be formed with a material of a suitable heat transfer coefficient.

Once sufficient thermal energy is transferred to the fluid within the bowl 110, the fluid reaches a predetermined pressure and/or temperature. Reaching the predetermined pressure and/or temperature results in a triggering event. One example of a triggering event is actuation of one or more needles 116. In one example, the release mechanism 119 is configured to release the needle 116 in response to sensor data, in response to a control signal, in response to a timer, in response to a predetermined condition, or the like. For example, the release mechanism 119 may release upon indication of a predetermined temperature of pressure being reached by the fluid contained within the bowl 110. To facilitate such a release, a temperature or pressure sensor may be positioned to relay the temperature or pressure of the fluid located within the bowl 110. It is contemplated that a controller may be positioned in the housing 115 to facilitate release of the needles 116. Alternatively, an external controller coupled to heat transfer device 100 may facilitate release of the needles 116.

The release mechanism 119 maintains each respective needle 116 in cocked or retracted position. Disengagement of a release mechanism 119, as described above, allows actuation of a respective needle 116 towards the internal container 108. Actuated needles 116 puncture sealing members 137 disposed over openings 114, thereby allowing fluid to flow from the internal volume 113 of the bowl 110 into the internal volume 105. As the fluid flows through opening 114, the fluid expands, resulting in a decrease in temperature (e.g., via a constant enthalpy) of the heated fluid. Thus, cooling of an object to which the heat transfer device 100 is thermally coupled occurs by transferring heat from the object to a fluid of the heat transfer device 100, and then subsequently increasing the temperature of the fluid via the Joule-Thomson effect.

FIG. 1A-1E illustrate one example of a heat transfer device 100. However, other configurations are also contemplated. For example, while the body 101 and the lid assembly 102 are shown having a cylindrical shape, it is to be noted that other shapes and configurations are also contemplated. In another example, it is contemplated that the number and position of puncturing devices 109 may be varied.

It is contemplated that the described triggering events may be passive, active, or a combination thereof. In one example, a passive triggering event includes melting a retaining substrate that either covers one or more openings 114, or that maintains a puncturing device 109 in a cocked position. In the latter example, upon melting, the puncturing device 109 releases to rupture a sealing member 137. Active triggering events include electronically sending a signal to facilitate actuation of the puncturing device 109, such as electronically triggering a release primer after electronically detecting that a temperature threshold has been exceeded.

In another example, it is contemplated that the puncturing devices 109 may be excluded. In such an example, it is contemplated that the sealing members 137 disposed over the one or more openings 114 are rupture disks configured to rupture at a predetermined pressure. Thus, once a predetermined pressure is reached within the bowl 110, rupturing of the rupture disks occurs and fluid is permitted to pass through the openings 114, as similarly described above. In such an embodiment, the design of the heat transfer device 100 is simplified, and the cost of manufacture is reduced due to the exclusion of the puncturing devices 109.

In yet another example, it is contemplated that release of fluid from within the bowl 110 may occur through both puncturing of sealing members 137 by the puncturing devices 109, and by rupturing of sealing members 137 due to a predetermined pressure within the bowl being realized. The use of both puncturable disks and rupturing disks augments reliability by offering redundant fluid-releasing avenues. In such an example, the rupturing disks may be configured to rupture at the same pressure (or a corresponding temperature) configured to engage the puncturing devices 109. Thus, the punctured sealing members (pierced by the puncturing device 109) and the rupturing disks (which rupture at a predetermined pressure) allow fluid flow through respective openings at about the same time. Alternatively, the heat transfer device 100 may be configured such that the puncturable sealing members are configured to release fluid flow first, and the rupturing disks are configured to release fluid flow at a second, later time, thus acting as a back-up or redundant fluid releasing operation. In another example, the rupturing disks may be configured to release fluid prior to the puncturable sealing members.

In another example, the fluid within the bowl 110 may include a wax or other material that absorbs heat to phase change to a liquid substance (e.g., melts) either before or during rupturing of the sealing members 137. The liquid substance may then absorb additional heat to phase change from a liquid substance to a gaseous form (e.g., vaporize), either before or after rupturing of the sealing members 137. In one instance, liquid-to-vapor phase changes occur before rupturing of the sealing members 137 when solid-to-liquid phase changes also occur before rupturing the sealing members 137. In another instance, liquid-to-vapor phase changes occur after the sealing members 137 rupture when the phase change from solid-to-liquid also occurs after rupturing the sealing members 137. Fluid within the bowl 110 may alternatively phase change from a solid directly and/or exclusively to a gas (e.g., sublimate) either before or after rupturing the sealing members 137. In some instance, cooling from the Joule-Thomson effect may reverse a phase change, temporarily reverse a phase change, and/or constitute a phase change to a more condensed state than originally stored. Phase changes to a more condensed state include one or more of a phase change from a gas to a liquid (e.g., condensing), a phase change from a liquid to a solid (e.g., freezing), and/or a phase change directly and/or exclusively from a gas to a solid (e.g., deposing).

In another example, melting of frozen/solid-state cooling fluid may contribute to pressure build-up within the internal volume 113 and/or frozen/solid-state cooling fluid may contribute in part or entirely to rupturing of the sealing member 137. Alternatively, the sealing member 137 may be ruptured using a primer, N-Glycerin, or excitation of $C_6H_2(NO_2)_3CH_3$.

In another example, it is contemplated that the release mechanism 119 may release the needle 116 in response to material dissolving once a predetermined condition, such as temperature, is met. For example, the needle 116 may be released once a retainer is melted. In such an example, the retainer may be lead ($_{82}Pb$), or another material with a desired melting point, e.g., Tin. In another example, the sealing member may be ruptured by other methods, including projected components, detonators, plasma ablators, shaped charges, or the like.

In yet another example, it is contemplated that the release mechanism 119 is an actuator that actuates the needle 116 towards the internal container 108. In such an example, the spring 117 is configured to bias the needle 116 into a retracted position. Thus, after the release mechanism 119 actuates the needle 116 to rupture a respective sealing member, the spring 117 returns the needle to a radially outward position to facilitate fluid from through a respective opening 114.

In yet another example, a compound with a relatively high heat transfer coefficient may be positioned between the heat transfer device 100 and an object to be cooled, in order to facilitate transfer of thermal energy therebetween. In other examples, the heat transfer device 100 may be configured to absorbed Electro-Magnetic (EM) radiation, including optical light, or heat induced through a pressure signal.

In another example, the needle 116 of a respective puncturing device may create a seal within the opening 114 such that the needle 116 regulates the flow of fluid through the opening 114. In such an example, the needle 116 may include one or more O-rings therein to facilitate sealing. In such an example, the needle 116 may completely stop fluid flow, if desired. When using the needle 116 to control fluid flow, it is contemplated that a controller may facilitate control of needle position. In doing so, either open-loop control or closed-loop control may be utilized. When utilizing closed-loop control, the closed-loop control may alter the pressure permitted past the needle 116 via the opening 114. Control routines that may be employed include proportional, proportional-integral, proportional-integral-derivative, Kalman, Kalman-bucy (simulation), Iterated Extended Kalman Filter (IEKF), Optimal Control, Adaptive Control, Fuzzy logic, Genetic Algorithm, Sliding Mode Control, and the like.

Figure 2A:
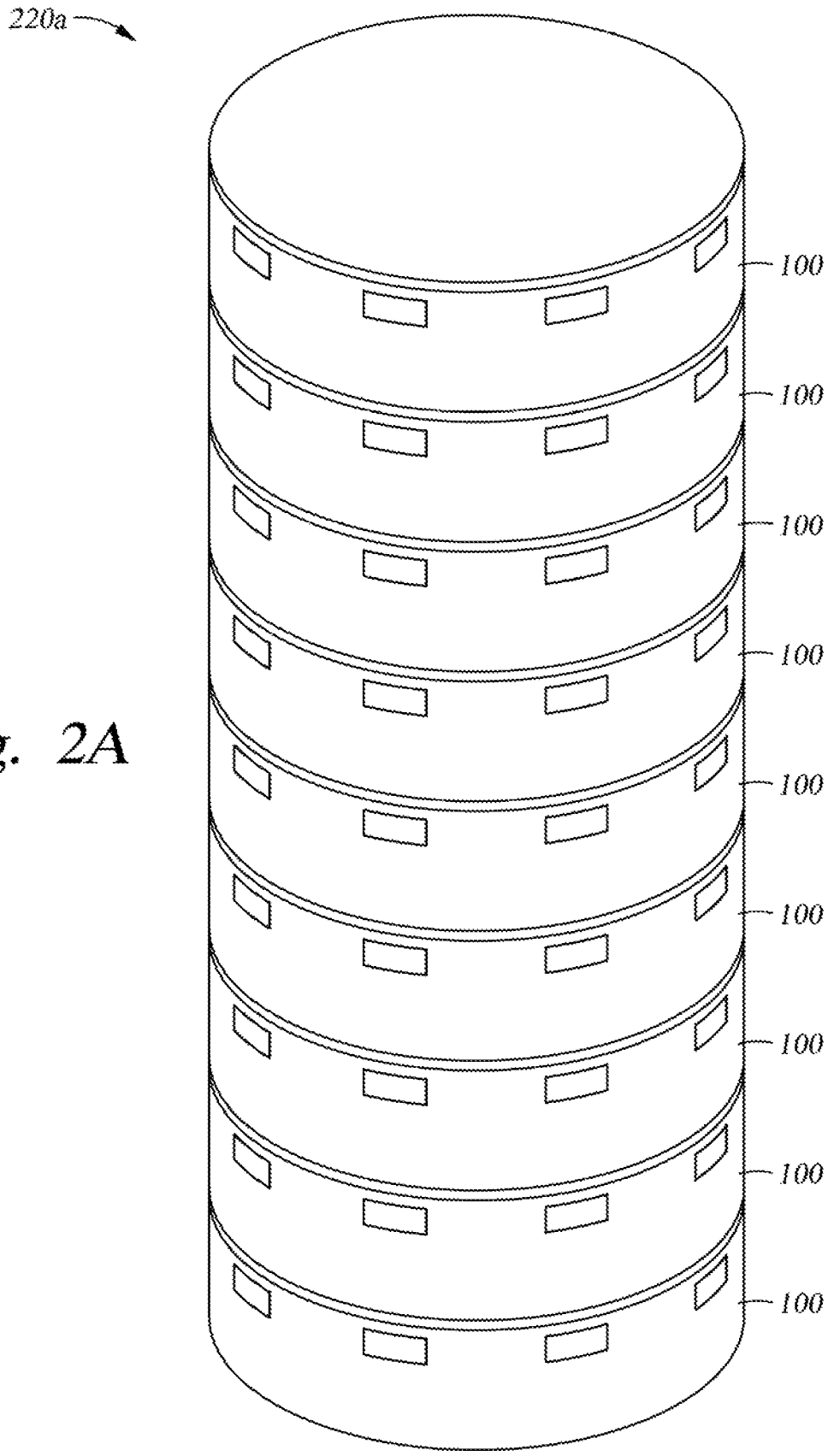
FIGS. 2A and 2B are schematic perspective views of heat transfer device arrangements, according to aspects of the disclosure.
Figure 2B:
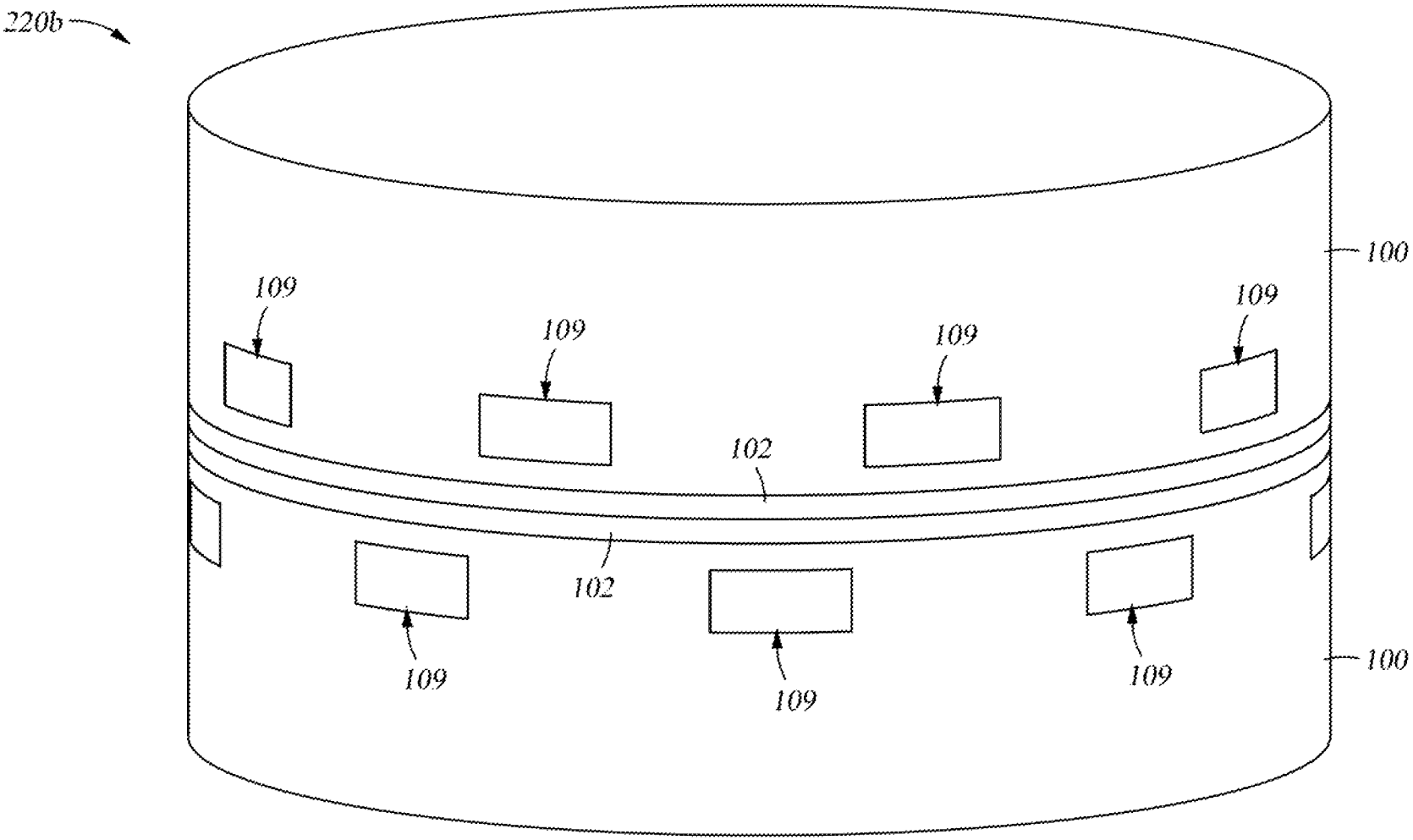

FIGS. 2A and 2B are schematic perspective views of heat transfer device arrangements 220*a*, 220*b*, according to aspects of the disclosure. The heat transfer device arrangement 220*a* includes a plurality of heat transfer devices 100 serially stacked in a vertical orientation. While nine heat transfer devices 100 are illustrated, it is contemplated that any number of heat transfer devices 100 may be utilized in the heat transfer device arrangement 220*a*. The heat transfer devices 100 are in thermal contact such that heat received by one heat transfer device 100 is transferred, at least partially, to an adjacent heat transfer device 100. Thus, the heat transfer device arrangement 220*a* improves cooling of an object in thermal contact with the heat transfer device arrangement 220*a*, as compared to when using only a single heat transfer device 100.

In the example of FIG. 2A, it is contemplated that thermal energy may be transferred between adjacent heat transfer devices 100 both prior to and after rupturing of sealing members 137 (shown in FIG. 1C) in one or more heat transfer devices 100. To facilitate transfer between adjacent heat transfer devices 100, it is contemplated that one or more heat transfer compounds (e.g., thermal grease, thermal film, thermal tape, and/or thermal straps) may be applied therebetween. In one example, it is contemplated that fluid-containing structure may be disposed between each successive heat transfer device 100 to facilitate heat transfer and/or heat absorption.

FIG. 2B is a schematic perspective view of a heat transfer device arrangement 220*b*. The heat transfer device arrangement 220*b* includes two heat transfer devices 100 in a lid-to-lid configuration, wherein the respective lid assemblies 102 are adjacent one another. In such a configuration, a first heat transfer device 100 is positioned upright, while a second heat transfer device 100 is inverted and positioned on the first heat transfer device 100. Such a configuration allows objects to be cooled to be positioned at opposite ends of the heat transfer device arrangement 220*b*: a unique arrangement for cooling of multiple objects in constrained spaces.

Figure 3A:
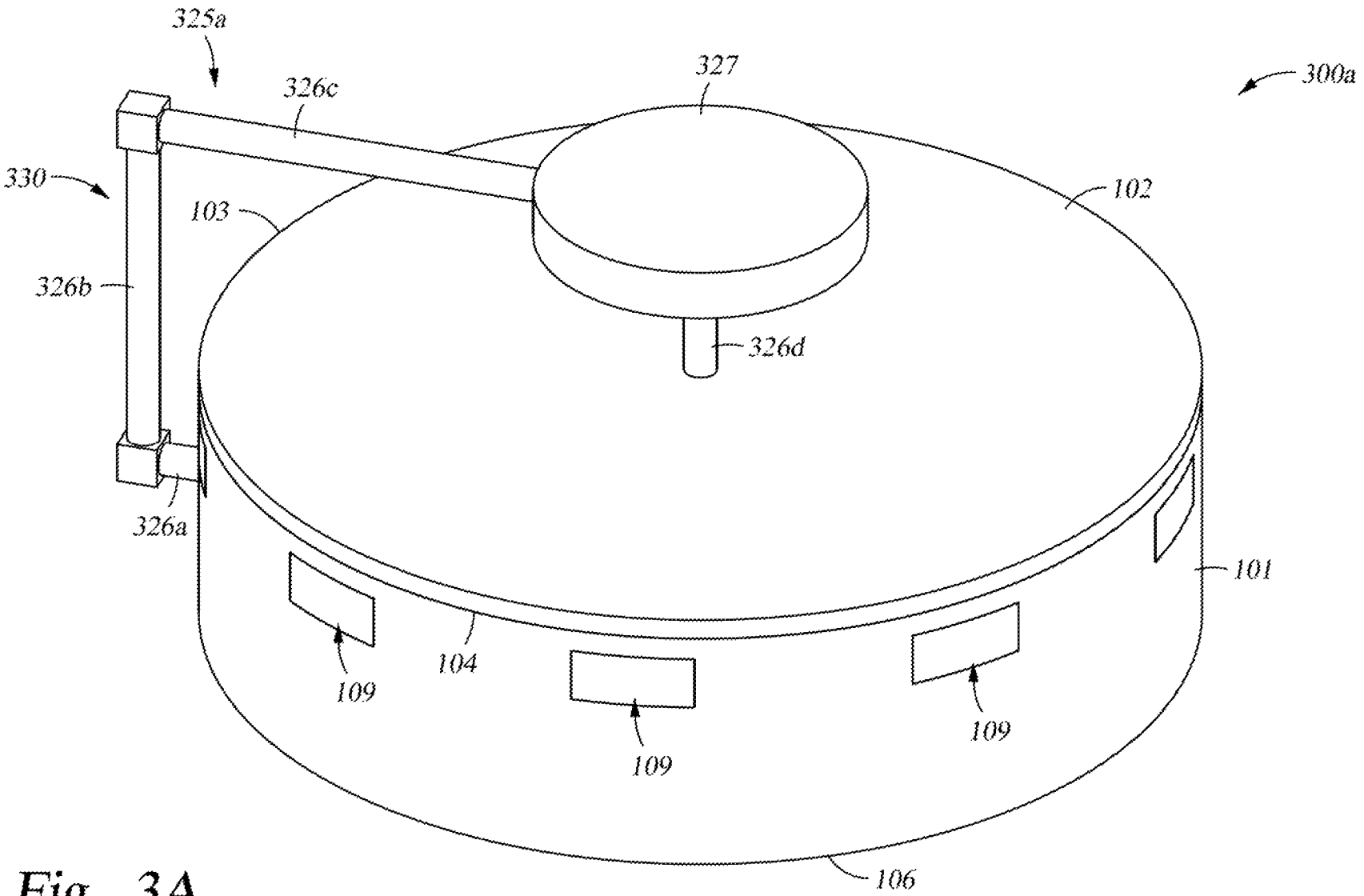
FIGS. 3A and 3B are schematic perspective views of heat transfer devices, according to other aspect of the disclosure.
Figure 3B:
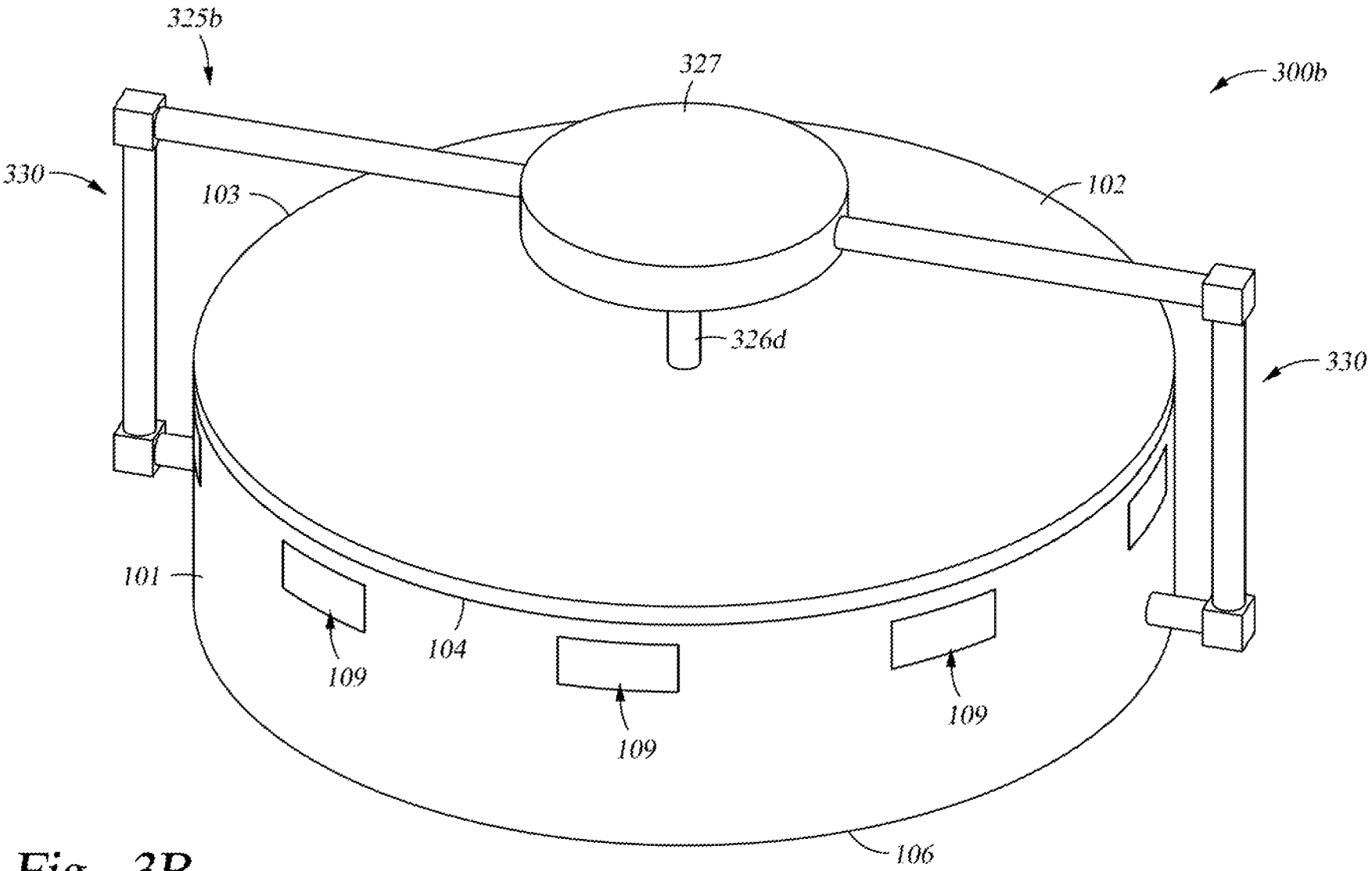

FIGS. 3A and 3B are schematic perspective views of heat transfer devices 300*a*, 300*b*, respectively, according to another aspect of the disclosure. The heat transfer devices 300*a*, 300*b* are similar to the heat transfer device 100, but additionally includes respective recirculation systems 325*a*, 325*b*. With reference to FIG. 3A, the recirculation system 325*a* includes a recirculation path 330 having one or more sections of tubing 326*a*-326*d* and a hub 327. The one or more sections of tubing 326*a*-326*d* are in fluid communication with the internal volume 113 of the bowl 110, as well as with the internal volume 105 (shown in FIG. 1C), thus facilitating recirculation of fluid upon rupturing of sealing members 137 (shown in FIG. 1C). The recirculation of fluid provides additional cooling beyond the initial release of heated fluid, by allowing multiple iterations of heating and expanding the fluid. Additionally, the one more sections of tubing 326*a*-326*d* and the hub 327 are spaced from the body 101 and the lid assembly 102 to facilitate cooling of fluid as the fluid travels through the recirculation system 325*a*. However, other configurations are contemplated, for example, when spacing is constrained.

In one example, upon rupturing of a sealing member 137, heated fluid is released into an internal volume 105 (shown in FIG. 1C). The released fluid is allowed to flow into the tubing 326*a*, then through tubing 326*c*, the hub 327, and the tubing 326*d*, successively. Fluid in the tubing 326*d* is directed back into the internal volume 113 of the bowl 110 (shown in FIG. 1C) to be heated once again. Thus, the fluid is capable of being heated and then being subjected to expansion, multiple times.

To facilitate multiple iterations of heating and expanding the fluid, it is contemplated that after a needle 116 ruptures a sealing member, the needle 116 may then be used to plug a respective opening 114. It is contemplated that such a needle 116 may be actuated to allow selective release of fluid through a respective opening 114. In one example, one or more needles 116 may passively operate as spring-loaded, pressure-reducing valves after initial rupturing has occurred. Thus, for subsequent fluid releases, the needles 116 would be disengaged to allow fluid to effuse through respective openings 114 once a predetermined pressure overcomes a bias force of a respective spring 117 (shown in FIG. 1E).

Additionally or alternatively, the needles 116 may rupture sealing members in succession. In such an example, once fluid is released by rupturing, a respective needle 116 permanently plugs the respective opening 114. To perform subsequent fluid releases, an alternative puncturing device 109 is utilized.

To prevent recirculation of fluid in a reverse direction, the hub 327 functions as or includes therein a one-way check valve. Thus, as fluid is heated in the bowl 110, heated fluid does not inadvertently travel backwards through the recirculation system. In addition, it is contemplated that the hub 327 may include additional components to facilitate recirculation and/or cooling of fluid, such as one or more of a radiator, a condenser, and a pump.

FIG. 3B is a schematic perspective view of a heat transfer device 300*b*. The heat transfer device 300*b* is similar to the heat transfer device 300*a*; however, the recirculation system 325*b* of the heat transfer device 300*b* includes multiple recirculation paths 330. While two recirculation paths 330 are shown, it is contemplated that more than two recirculation paths 330 may be utilized. Additionally, in the illustrated example, the recirculation paths 330 are coupled to a shared hub 327. However, it is contemplated that the recirculation paths 330 may alternatively utilize individual hubs 327.

Figure 4A:
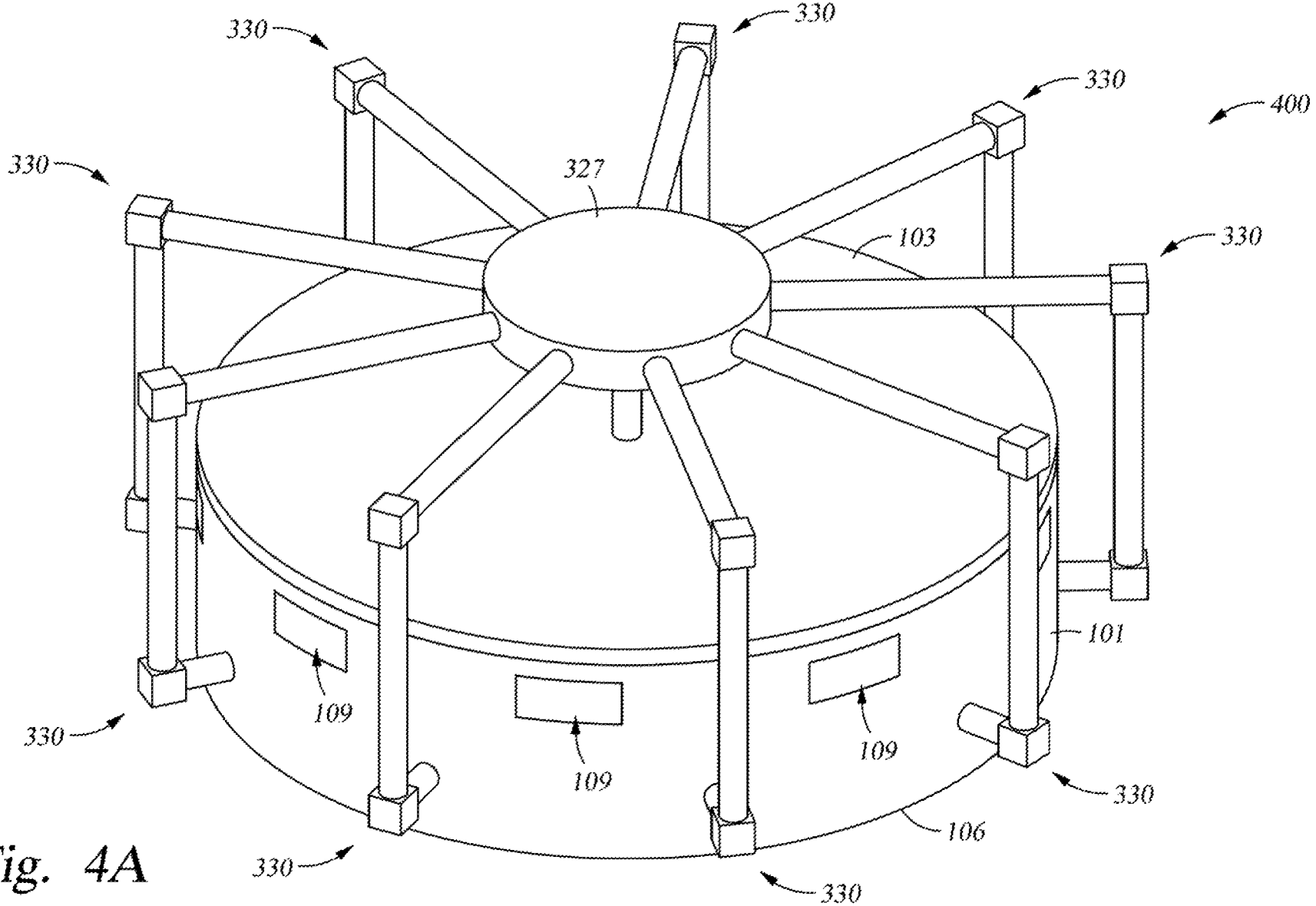
FIG. 4A is a schematic perspective view of a heat transfer device, according to another aspect of the disclosure.
Figure 4B:
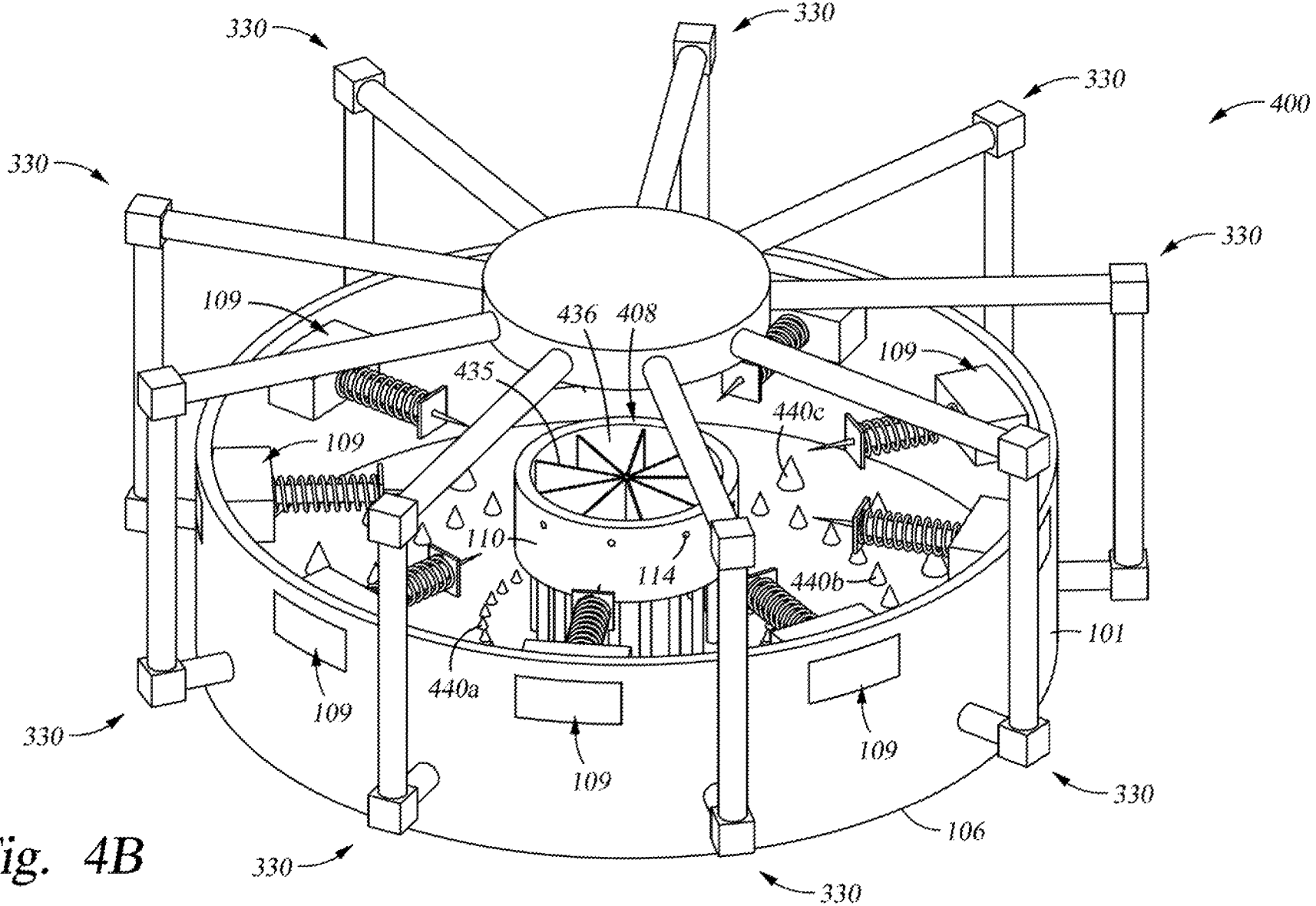
FIG. 4B is a partial schematic perspective view of the heat transfer device of FIG. 4A.
Figure 4C:
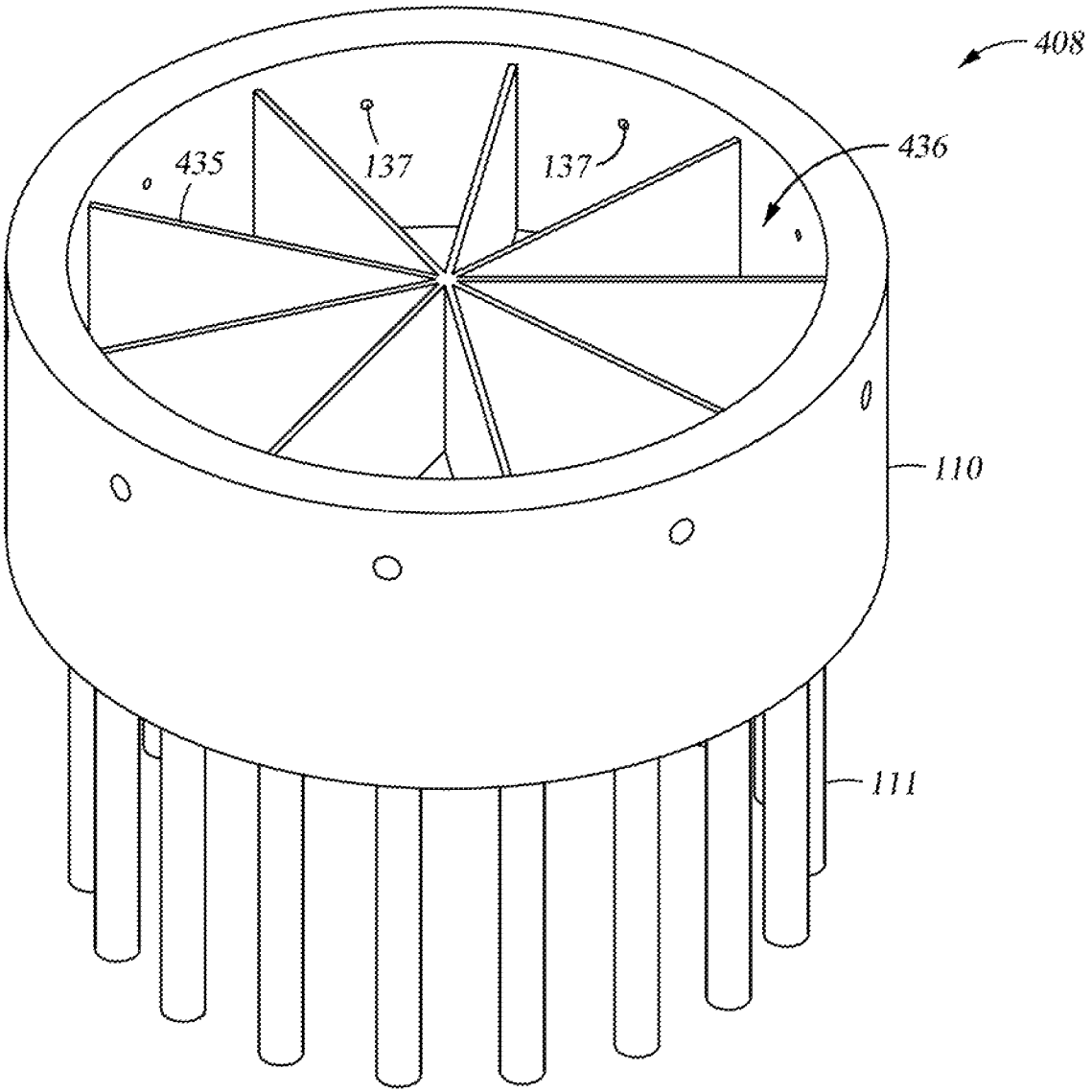
FIG. 4C is a schematic perspective view of an internal container of the heat transfer device of FIG. 4B.

FIG. 4A is a schematic perspective view of a heat transfer device 400, according to another aspect of the disclosure. FIG. 4B is a partial schematic perspective view of the heat transfer device 400 of FIG. 4A. In FIG. 4B, the cylindrical plate 103 of the lid assembly 102 is not shown for explanatory purposes. FIG. 4C is a schematic perspective view of an internal container 408 of the heat transfer device 400 of FIG. 4B. To facilitate explanation, FIGS. 4A-4C will be explained in conjunction.

The heat transfer device 400 is similar to the heat transfer device 300*b*; however, the heat transfer device 400 includes nine recirculation paths 330 coupled to a central hub 327. The recirculation paths 330 are equally spaced around the heat transfer device 100. Each of the recirculation paths 330 is fluidly coupled to an internal volume 105 of the body 101 at a position located between adjacent puncturing devices 109.

With reference to FIG. 4B, the heat transfer device 400 includes an internal container 408, in contrast to the internal container 108 (shown in FIG. 1C) of the heat transfer device 100. The internal container 408 is similar to the container 108, but includes one or more partitions 435 disposed in the bowl 110 and dividing the interval volume 113 into a plurality of individual compartments 436. In FIGS. 4B and 4C, the one or more partitions 435 radially extend outward, forming wedge-shaped compartments 436; however, other configurations are contemplated. The compartments 436 are isolated from one another, and aligned with one or more openings 114. In one example, each compartment 436 is aligned with a single, corresponding opening 114.

During operation, the heat transfer device 400 is configured such that each compartment 436 is individually vented. Thus, in the example shown, nine separate venting operations (e.g., heating and expansion of fluid) occur. For example, heat from an object may be transferred to the bowl 110 through heat sinks 111 as described above. Once a predetermined heating condition is reached in the bowl 110, a sealing member 137 (shown in FIG. 4C) is ruptured by a respective puncturing device 109 to facilitate release of a heated fluid through the opening 114. The fluid may be selectively recirculated though one or more recirculation paths 330. As additional cooling is desired, additional puncturing devices 109 may deploy to rupture respective sealing members 137, thereby releasing heated fluid for expansion, and thus, cooling.

As further illustrated in FIG. 4B, the base 106 of the body 101 includes additional heat sink features 440*a*, 440*b*, and 440*c*. The heat sink features 440*a*, 440*b*, and 440*c* include concentric circles of heat sinks coupled to an internal surface of the base 106. While three concentric circles are illustrated, it is contemplated that more than three concentric circles may be utilized. In one example, each radially outward circle of heat sink features 440*a*, 440*b*, 440*c* includes increasing larger conical, spaced-apart, heat sinks. Other shapes and configurations are also contemplated. The additional heat sink features 440*a*, 440*b*, and 440*c* facilitate heat removal from an object to be cooled, as well as facilitate turbulent mixing of fluid within the heat transfer device 400.

Referring to FIG. 4C, heat sinks 111 are disposed about the perimeter of the bowl 110, extending from a lower surface thereof. It is contemplated that such a configuration facilitates uniform heat transfer to fluid in the bowl 110, while mitigating weight. However, it is contemplated that additional heat sinks 111 may be coupled to the lower surface of the bowl 110. Such heat sinks may be located interior of the perimeter, e.g., radially inward of the heat sinks 111 illustrated in FIG. 4C.

Figure 5A:
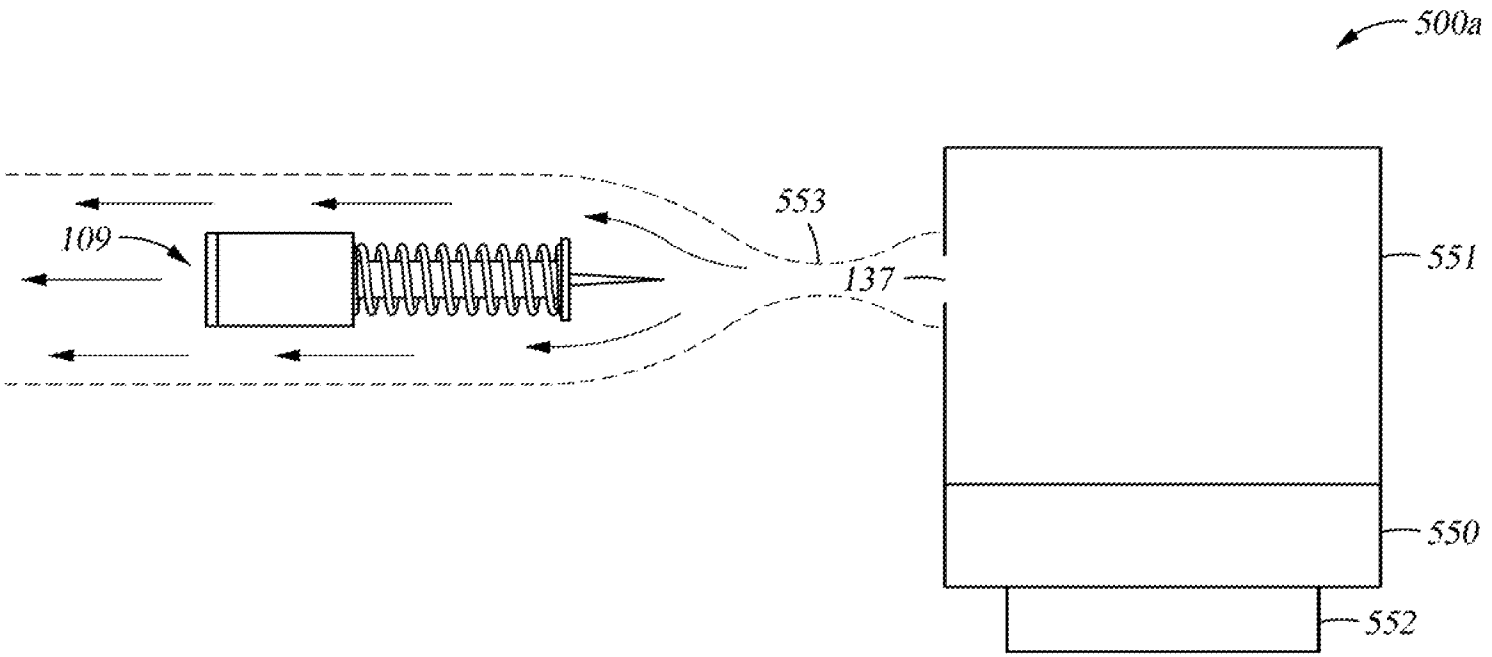
FIGS. 5A and 5B are schematic side views of heat transfer devices, according to aspects of the disclosure.
Figure 5B:
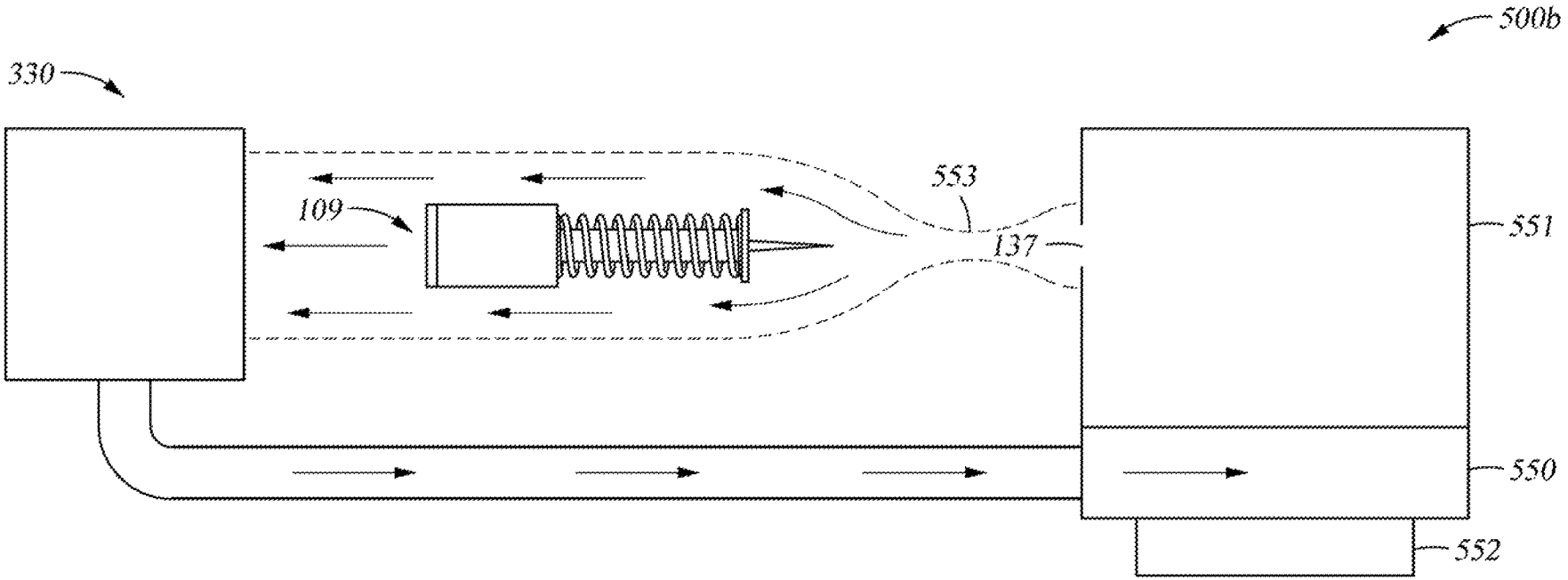

FIGS. 5A and 5B are schematic side views of heat transfer devices 500*a*, 500*b*, according to aspects of the disclosure. The heat transfer device 500*a* includes a bottom container 550 and an upper container 551. The bottom container is configured to be positioned adjacent to and in contact with an object 552 to be cooled. The bottom container 550 is a hollow cavity containing a heat transfer medium, such as a fluid, therein. In one example, the bottom container 550 contains a liquid coolant (at room temperature and atmospheric pressure) therein, and is filled 95 percent or more, such as 99 percent or 100 percent. In some instances, the bottom container 550 may protect the object 552 during a rupture event.

The upper container 551 is a housing containing a fluid therein, such as a cooling gas. In one configuration, the liquid in the bottom container 550 is at an initial temperature and pressure less than the gas in the upper container 551. The fluid in the upper container 551 is heated via heat received from the lower container 550. Once the heated fluid reaches a predetermined temperature or pressure, a sealing member 137 (shown in a ruptured state) is ruptured by a puncturing device 109 to allow the fluid to escape through a venturi 553, depressurizing and cooling the fluid.

In an alternative example, it is contemplated that the lower container 550 may be excluded. In such an example, the upper container 551 may be positioned adjacent to or in contact with the object 552 to receive thermal energy therefrom. In another example, it is contemplated that the puncturing device 109 may be supported by an object other than the heating device 500*a*. In such an example, the puncturing device 109 is coupled to another object, but directly to actuate towards the heating device 500*a*, causing rupturing of the sealing member 137.

In another example, the upper wall of the bottom container 550 or the lower wall of the upper container 551 may be a flexible membrane, including applications for flexible LCD and/or OLED displays. It is contemplated that such a membrane may be configured to rupture and mix with the fluid located in the upper container 551. Such rupturing may also provide some cooling via a depressurizing event.

FIG. 5B is a schematic side view of a heat transfer device 500*b*. The heat transfer device 500*b* is similar to the heat transfer device 500*a*, but includes a recirculation path 330. Upon release of the heated and pressurized fluid from the upper container 551, the released fluid travels through the recirculation path 330 and reenters the lower container 550 to facilitate transfer of additional thermal energy from the object 552. A one-way check valve may be provided at the interface of the recirculation path 330 and the lower container 550 to prevent undesired backflow into the recirculation path 330.

Benefits of aspects disclosed herein include simplified heat transfer devices having reduced size and weight. For example, it is contemplated that heat transfer devices herein may have a diameter as small as 1 inch, such as about 6 inches. Additionally, heat transfer devices disclosed herein are driven by waste/excess heat from another source which is transferred into the heat transfer device and becomes the driving mechanism for fluid past a venturi. Driving the fluid past the venture causes a fluid, such as a liquid, to build a vapor pressure and reduce temperature of the fluid through vaporization. Thus, heat transfer devices disclosed herein benefit from a simplified design compared to conventional approaches.

Also, heat transfer devices disclosed herein may be entirely resistant to Electro-Magnetic (EM) fluctuations in nearby environments and/or produce virtually no EM noise themselves. Additionally, aspects of the disclosure may remove or transfer heat while being resistant to pressure fluctuations in nearby environments and/or while producing virtually no pressure noise, including audio noise (e.g., via minimal vibration of the heat transfer device 100, which in turn projects minimal-to-no pressure waives in the ambient atmosphere), as an example in high vibration scenarios.

While the above description provides some examples and embodiment, further examples and embodiments are also contemplated.

In one example, released fluids may pass through a plurality of chambers (in series or parallel) to further enhance cooling. In an example where successive chambers are utilized, the fluid may pass through a venturi at each interface of successive chambers. In another example, each heat transfer device may be either open-looped or closed-looped. In an open-loop configuration, vaporized fluid is expelled from the heat transfer device and is either dumped from the heat transfer device by one or more radiator(s) or expelled to the atmosphere. In a closed-loop configuration, a recirculation path is utilized, as described above.

In another example, it is contemplated that the puncturing device may include a first ball and spring valve. In such an example, instead of venting the heated fluid into the environment, the fluid is vented through the ball and spring valve into a second chamber to enable sufficient cooling of the first volume (e.g., the internal volume 113) or of heat source, such as an object desired to be cool. It is contemplated that the second chamber may include a second ball and spring that is located within the second chamber. The second ball and spring valve may be unidirectional in direction opposite of the first ball and spring valve. Fluid may be pumped back into the first chamber (e.g., the internal volume 113) through the second ball and spring valve to facilitate repetition of the cooling process. This configuration is useful for applications ranging from spacecraft to submersibles to oceanic to subterranean. Such a configuration is beneficial because the cooling process is not limited to single use. In one example, the first chamber may be a component of (or used to cool) an electronic device. In such an example, after releasing fluid from the internal volume 113, the electronic device could be turned "ON." When using a ball and spring valve, the spring may be resistant to high temperatures, and/or may be coated with a spark-suppression substance. Additionally or alternatively, the spring may be a hairspring to create a low-profile and small device for small applications.

Additionally or alternatively, the puncturing device may be a ball-and-spring valve (e.g., a check valve), where flow-rate, displacement, pressure, and compression are all inter-related. Sensing may occur as an example by connecting a linear transducer to a sliding poppet or by connecting strain gauges to membrane valves.

In some examples, the heat transfer devices may include additional structural components, such as an in-wall iso-grid that provides light-weight pressure re-enforcement to facilitate structural rigidity. In some instances, the heat transfer device is applied to the cavities of an iso-grid, including cavities of an iso-grid dish. The heat transfer device may be applied to an antenna, an antenna dish and even a mirror. Additionally or alternatively, the disclosed heat transfer devices may contain in-wall additively manufactured rib-stiffeners, such as vertical flutes, to help resist compression and/or serve the dual purpose of another medium/heat-path of heat transfer, be it convective, conductive, and radiative and/or some other heat transfer mode. In some examples, the iso-grid may function as a "Mills" shaping for purposes including ejection or separation of a hot device. Such "Mills" shaping may be internally or externally etched into the device, wherein flat faces of the device may have a recessed star or flower pattern or may even have a waffle-grid countersunk etch pattern.

In some aspects, the disclosed heat transfer devices may be constructed with use of metallic Additive Manufacturing. It may also be post-processed with strength-improving techniques including Hot Isostatic Press (HIP) and/or Heat Treat (HT). In both Additive Manufacturing and traditional manufacturing, the device may be coated with thermal resistive coating including but not limited to Silicon-Carbide and/or Zirconium. Exemplary metallic additive manufacturing methods and printers include direct energy deposition, direct metal laser sintering, direct metal printing, electron beam additive manufacturing, electron beam melting, electron beam powder bed, fused deposition modeling, indirect power bed, laser cladding, laser deposition, laser deposition welding (optionally with integrated milling), laser engineering net shape, laser freeform manufacturing, laser metal deposition-powder, laser metal deposition-wire, laser powder bed, laser puddle deposition, laser repair technology, powder directed energy deposition, stereolithography, selective laser melting, selecting laser sintering, and small puddle deposition.

Exemplary additive manufacturing materials include metals such as steel, stainless steel, titanium, copper, aluminum, nickel alloys, and alloys thereof, including but not limited to IN625, IN718, Ti-6Al-4V, AlSi10Mg, SS316, Monel, Copper, Ti-5553, Ti-6Al-6V-2Sn, Ti-6242, Maraging Steel MSI 18, Mar 300, 316L, 17-4, 15-4, Cobalt Chrome SP2, Ti-6Al-4V ELI, Nickel Alloy HX, gold (AU), silver (Ag), as well as plastics including Acrylonitile Butadiene Styrene (ABS), Polylactic acid (PLA), Polyvinyl alcohol, and Polycarbonate, and others including ULTEM, Kel-F, Kevlar, Nylon, and Carbon Composite, as well as thermoplastics such as Polyamide (PA), Polyphenylene Sulfide (PPS), Polyether Ether Ketone (PEEK), Poly-Ether-Ketone-Ketone (PEKK), Polyetherimide (PEI), Polyphenylsulfone (PPSU), Polyethersulfone (PES), Thermoplastic Polyimide (TPI), liquid crystalline polymer (LCP), polyamide-imide (PAI), or the like (U.S. Pat. No. 10,479,520). Further, support materials may be used, such as support materials for plastics like PVA or support materials for metallics, including water-soluble crystals and other melt-aways, including, but not limited to Cu, Ag, Al, Sb, Zn and Sn, as well as other alloys such as solder and low melting point Ag alloy solder (Ag—Sn—Pb, Ag—Pb, Ag—Sn, Ag—Sn—Cu, Ag—Cd—Zn, Ag—Cd); polyethylene, polyamide, polyimide, polypropylene, PMMA, polyether sulfone, thermoplastic polyester, copolymer or polyhexafluroropropylene and polytetrafluoroethylene, polyfluorovinylidene, and other organic composite photoresist materials, including but not limited to dry film type resists (U.S. Pat. No. 5,805,971). The device may be constructed with non-thermoplastic materials, including epoxies, including high-temp resistant epoxies.

In one example, the heat transfer devices disclosed herein may be formed by altering the blending of deposited additively manufactured material such that Functionally Gradient Material (FGM) properties may be achieved, including varying the Coefficient of Thermal Expansion (CTE). Such varying may be useful for passive actuation of puncturing devices.

Additionally or alternatively, heat transfer devices disclosed herein may be formed using melt-away materials such as Ag—Sn—Pb, Ag—Pb, Ag—Sn, Ag—Sn—Cu, Ag—Cd—Zn, Ag—Cd), polyethylene, polyamide, polyimide, polypropylene, PMMA, polyether, sulfone, thermoplastic, polyester, copolymer of polyhexafluoropropylene and polytetrafluoroethylene, polyfluorovinylidene, organic composite photoresist materials and dry film resists. In such an example, a sealing member of the heat transfer device may exhibit a higher melting point threshold than a respective melt-away support material.

In another example, disclosed heat transfer devices may be constructed of AM materials, including AlSi10Mg, Ti-6Al-4V, Inconel625, Inconel718, SS316, Ti-5553, Ti-6Al-6V-2Sn, Ti-6242, Mar 300, 316L, 17-4, 15-5, CobaltChrome MP1, Cobalt Chrome SP2, Nickel Alloy HX, Bronze, Copper, and Monel. The heat transfer devices may be powder-formed by processes including Gas Atomized, Plasma Atomized, and Plasma Rotating Electrode formation processes. In such an example, a sealing member of the heart transfer device may exhibit a lower melting point threshold than a primary structure material. In one example, powder may be formed as collected waste powder or produced powder from Electrical Discharge Machining (EDM) machining processes.

In another example, one or more parts of the heat transfer devices may be formed from plastics, including but not limited to Nylon, acrylonitrile butadiene styrene, polyactic acid, polyetherimide (ULTEM®), Carbon fiber, para-aramid synthetic fibers (Kevlar®), polychlorotrifluoroethylene, polytetrafluoroethylene (Teflon™), and polyethylene terephthalate. In such an example, a sealing member of the heart transfer device may exhibit a lower melting point threshold than a respective primary structure material.

In another example, the disclosed heat transfer devices may be constructed of flexible material for purposes of resiliency to high-vibration regimes, flexure in aeroelastic applications, and/or compact storage and inflation during operation, and/or use in inflatable or elastic devices including the dirigible, an automotive tire, or embedded/implanted elastic/flexible membranes. The heat transfer device may be fixed to a break pad, a hollow cylinder such as a barrel, or any portion of a firearm for any firearm, including the Nepalese Bira, a power-generating reactor, in or on an axel, bearing or bushing, on a micro-wave, oven, coffee maker, toaster, or battery. The heat transfer device may be fixed to a revolving body, including a revolver. It may be affixed to a revolving volume, including a revolving room or elevator, including an elevator which may pass between and/or within elevator shafts and/or transportation mediums.

In one example, heat transfer devices disclosed herein may be geometrically shaped to fit within a diamond, hexagonal, triangular or other geometrically shaped pocket on interior, exterior or a wall of a structure, such that maximum surface contact is achieved for transfer of heat and/or maximum packing density of heat transfer devices is achieved. In one example, conductive coating may be plasma-deposited on an exterior pattern to directly overlay any iso-grid pattern.

In another example, it is contemplated that a heat transfer device may be formed integrally with a wall or surface of a structure via additive deposition during construction of an object. Alternatively, a heat transfer device may be secured to a wall of a structure via welding or abrading, including linear friction welding. In yet another example, it is contemplated that heat transfer devices described herein may have features selectively altered (e.g., acidly eroded) during a lifetime of operation of the heat transfer devices to coincide with intended variances in performance. The structural altering may include etching induced by an internal fluid, oxidation, selective melting induced by a heat source, and the like.

In some instances, the disclosed heat transfer devices may double as a capacitor or energy storage device, where charge may be altered via selective expulsion of internal fluid, and/or where a structural housing may serve as an electrode (cathode or anode) for charge and discharge.

In some examples, the disclosed heat transfer devices may have surfaces that include micro-inclusions, including hydrophilic or superhydrophilic pores, such that liquids such as thermal paste, light-absorbing paint, and/or adhesives, are easily applied.

In another example, the disclosed heat transfer devices may constitute a portion of a fastening device, including the head of a screw/bolt, a washer, and/or a nut, and/or a bearing or bushing. In another example, the disclosed heat transfer devices may constitute all or a portion of an exoskeleton or a conformally-shaped layer of a re-entry vehicle. Additionally or alternatively, the heat transfer devices may be coupled to or form part of a solid-state launch vehicle, including a re-usable launch vehicle. In another example, the resonant frequency modal responses of the disclosed heat transfer devices (including the needle 116 and/or body 101 and/or the lid assembly 102) may be designed to correspond with the operational envelope of a vehicle which may pass through varying pressure regimes and/or varying mission objectives.

In another example, the thickness of the walls of the housing and the lid assembly may be sufficiently thin to achieve quality inspection via radiographic/X-ray and/or CT scanning.

In one example, fluids contained within the heat transfer devices may include reactive elements, such as $NaN_3$ and/or $KNO_3$. In one example, a heterogeneous fluid contains small particles, including small electronic devices, that operate on a dependent relationship which may passively react, including expansion, contraction, or release or absorption of a substance, during a certain event, including surpassing of a temperate or acceleration threshold and/or receipt of an EM signal and/or variance in such element's net voltage.

Implementations of the disclosed heat transfer devices may include installation of the heat transfer devices to the underside of the build plate of a metallic or plastic additive manufacturing printer to facilitate cooling. Implementations of the disclosed heat transfer devices may also include regenerative braking devices of automobiles, as well as any other system, such as systems which revolve about at least one axis of rotation, including the internal structure of a commercial turbojet. In another implementation, the heat transfer devices described herein may cool one or more components of a computer or a super computer, including processors. In such an example, the relatively small foot print of the disclosed heat transfer devices facilitates close placement to a desired component of a computer.

Additional contemplated implementations include conformal applications, such as tiles on the donut-shaped Tokomak energy provider, conformal surfaces of a commercial re-entry vehicles, and the conformal surface of a thruster or hyperloop vehicle; protective equipment such as helmets; thin-profile applications within communication or electronic devices, including laptops, computers, smart phones, displays, or tablets; adhesion to processors, memory devices, or motherboards; devices within automotive, space, aerospace, or marine arenas; vehicles or stationary machines or other applications such as mining where the device is attached to or a component of a milling bit; other applications where the heat transfer device may take a large form as a container for liquid fuel in marine-, automotive-, space-, and aerospace-vehicles as well as stationary machines; and/or other applications where the heat transfer device cools an O-ring or seal and/or gasket, or the heat transfer device functions as the O-ring, seal and/or gasket, and/or where the heat transfer device may carry desired mass to serve as the rotational mass of a Reaction Wheel Assembly (RWA) and/or a Control Moment Gyroscope (CMG).

In some instances, disclosed cooling devices may be fixed to a charging device, including a charging device that plugs into a vehicle, a receptacle port for a charging device within a vehicle, and/or a charging device that plugs into a machine, including an additive manufacturing printer. The disclosed cooling devices may be affixed to any battery in any automotive or machine, including an additive manufacturing printer. The disclosed cooling devices may be affixed to any hot element in any vehicle or machine, including the deposition head within and additive manufacturing printer. Machine as used herein includes electronic and/or communication devices.

While the disclosed heat transfer devices may be modularly attached to electronic components, the heat transfer devices may also be a component of an electronic device. For example, a heat transfer device may be embedded within a structure, such as a structural component of a flash-memory drive, memory card, thumb-drive, hard drive, and the like. Further, such electronics may be nested within a body of the heat transfer device. As an example, a flash-memory drive may be modularly or permanently inserted within the heat transfer device.

Additional implementations include converting heat to electrical energy by utilizing the exhausted fluid to perturb one or more pistons on a pneumatic engine (e.g., a fly-wheel engine), and/or as an Auxiliary Power Unit (APU) of a commercial aircraft. Additionally, the disclosed heat transfer devices may cool an engine or energy source which may produce energy via plasma emission, or may extract and/or convert energy from an energy source which produces energy via plasma emission. The disclosed heat transfer devices may be attached to or a component of an engine, including both a piston engine and a rotary engine, a combustion engine for applications on marine-, terrainian- (including automotive), subterranean- (including mining), airborne- (including the turbofan engine), submersible- (including underwater drilling), and space-based applications.

Additional implementations include cooling high-temperature batteries via securing of the heat transfer device to a surface of the battery and/or embedding the heat transfer device to the surface of the battery and/or creating a structure of the battery housing which includes the heat transfer device described above. The disclosed heat transfer devices may also cool an Euler plate or wobble plate of a Variable Elliptical Drive (VED) by securing the heat transfer device to the plate, or by forming teeth around the perimeter of the heat transfer device such that the heat transfer device functions as the Euler plate. The disclosed heat transfer devices may also be utilized where expulsion of vaporized fluid may have desirable effects on the function of a gear network, including lubrication of the gears and/or spark suppression. The heat transfer device may be coated with static dissipative spray and/or flame-resistant spray. Exemplary gears include a planetary gear, a worm gear, a power screw, a bevel gear, a cycloidal gear, and/or other elliptical components like the inner or outer race of a bearing, a journal bearing, and/or a roller bearing. In another example, the disclosed heat transfer devices may function as a wheel or otherwise be formed onto a wheel. In one example, the device is mounted to an EM brake for gearing of rotorcraft.

Additional implementations include preventing overheating and/or facilitating heat transfer from an electrode in an electrical transferring connection when charging or draining of electrical batteries. In one example, a cooling device may be embedded within, partially within, and/or around the electrode or near the electrode, including but not limited to conformally shaped or integrated with the electrode.

Additional implementations include preventing overheating and/or facilitating heat transfer of a photon-receptive device, including photo-voltaic collectors such as P-N junction, monocrystalline, polycrystalline, thin film, Type I, Type II, Type III, amorphous silicon, Cadmium Telluride, bio-activated cells, flexible cells, bio-hybrid, buried contact, concentrated pV, Copper indium gallium selenide, Crystalline silicon, dye-sensitized, gallium arsenide germanium, hybrid solar, luminescent solar concentrator, micromorph, monocrystalline, multi-junction, nanocrystal, organic solar, perovskite solar, photo electrochemical, plasmonic, plastic solar, polycrystalline solar, polymer solar, quantum dot, solid-state solar, wafer solar, photo electrochemical cells for solar water splitting, and nanotube arrays. In other examples, the device is affixed to bio-medical devices, including devices used for medical treatment as well as devices temporarily or permanently secured to or within biological organisms.

In one example, the fluid used within the heat transfer devices is nitrogen gas, or another environmentally-friendly gas. In some examples, the exhausted fluid of the heat transfer devices may be mixed with the exhaust stream of another object, such as a vehicle. In some examples, the fluid is an inert substance.

The expulsion of vaporized fluid from heat transfer devices may provide back-pressure to stiffen the structure of a larger pressure vessel or to check against the inflow of outer fluids or gases. Additionally or alternatively, the expulsion of the vaporized fluid may be used to provide thrust to an object or dump momentum. In one example, expulsion of the fluid may provide Active Flow Control (AFC) and/or Passive Flow Control (PFC), and/or Synthetic Jet Actuators (SJA), and may be used on the surface and/or body of a flight vehicle, and/or may be utilized in connection with fluidic oscillation. Additionally or alternatively, exhausted fluid may be used to affect the surrounding environment, including effecting temperature or pressure changes, extinguishing a fire, and/or disabling an electronic device.

Aspects of the present disclosure may take the form of an entirely hardware embodiment, an entirely software embodiment (including firmware, resident software, micro-code, etc.), or an embodiment combining software and hardware aspects that may all generally be referred to herein as a "circuit," "module" or "system." The present disclosure may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

These computer readable program instructions may be provided to a processor of a general purpose computer, special purpose computer, or other programmable data processing apparatus to produce a machine, such that the instructions, which execute via the processor of the computer or other programmable data processing apparatus, create the means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block, blocks, or graded blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

While the foregoing is directed to embodiments of the present disclosure, other and further embodiments of the disclosure may be devised without departing from the basic scope thereof, and the scope thereof is determined by the claims that follow.

What is claimed is:

1. A heat transfer device, comprising:

a body;

a lid assembly positioned on the body and defining an internal volume of the body;

an internal container located within the body, an outer wall of the internal container spaced apart from an inner wall of the body, the internal container including a bowl having an internal volume therein, the internal volume of the bowl separated from the internal volume of the body by a sealing member positioned over an opening formed through a sidewall of the bowl, the opening including a venturi; and a puncturing device positioned to rupture the sealing member.

2. The heat transfer device of claim 1, further comprising a plurality of heat sinks extending between the bowl and the body.

3. The heat transfer device of claim 1, further comprising a recirculation system, the recirculation system having a first end coupled to the body and a second end coupled to the lid assembly.

4. The heat transfer device of claim 3, wherein the recirculation system includes a plurality of recirculation paths.

5. The heat transfer device of claim 1, wherein the puncturing device includes a spring-loaded needle.

6. The heat transfer device of claim 5, wherein the puncturing device includes a stop plate coupled to the spring-loaded needle, the stop plate configured to engage the bowl of the internal container.

7. The heat transfer device of claim 1, wherein the sealing member seals the opening formed through a sidewall of the bowl.

8. The heat transfer device of claim 7, wherein the opening is in fluid communication with a venturi.

9. The heat transfer device of claim 1, wherein the puncturing device includes a plurality of puncturing devices radially spaced about the internal container.

10. The heat transfer device of claim 9, wherein each of the plurality of puncturing devices is aligned with an opening formed through a sidewall of the bowl.

11. The heat transfer device of claim 10, wherein the internal volume of the bowl is partitioned into wedge-shaped compartments.

12. The heat transfer device of claim 1, wherein the internal container is positioned concentrically with respect to the body.

13. A heat transfer device, comprising:

a body;

a lid assembly positioned on the body and defining an internal volume of the body;

an internal container located within the body, the internal container including a bowl having an internal volume therein, the internal volume of the bowl separated from the internal volume of the body by a plurality of sealing members positioned over openings formed through a sidewall of the bowl, the openings each including a venturi; and a plurality of puncturing devices radially disposed around the body and aligned with each opening to rupture respective sealing members.

14. The heat transfer device of claim 1, further comprising a venturi in fluid communication with the opening formed in the bowl when the sealing member is in a ruptured state.

15. A method of cooling an object, comprising:

positioning a heat transfer device adjacent to the object, the heat transfer device including, a body, a lid disposed on the body, and an internal container located within the body, the internal container including a sidewall opening comprising a venturi;

transferring heat from the object to fluid housed in the heat transfer device, thereby increasing a temperature and a pressure of the fluid;

rupturing a sealing member formed over the sidewall opening of the internal container with a puncturing device to release the heated fluid and allowing the fluid to expand and cool.

16. The method of claim 15, wherein the heated fluid is released through the venturi.

17. The method of claim 15, wherein the puncturing device is a needle.

18. The method of claim 15, wherein the released fluid is recirculated within the heat transfer device.

19. The method of claim 15, wherein the internal container includes a bowl, and the opening is formed in the bowl.

* * * * *